US007103469B2

(12) United States Patent
Hosoya et al.

(10) Patent No.: US 7,103,469 B2
(45) Date of Patent: Sep. 5, 2006

(54) CONTROL APPARATUS FOR VEHICLE AND METHOD THEREOF

(75) Inventors: Hajime Hosoya, Atsugi (JP); Naoki Tomisawa, Atsugi (JP)

(73) Assignee: Hitachi, Ltd., Tokyo-to (JP)

( * ) Notice: Subject to any disclaimer, the term of this patent is extended or adjusted under 35 U.S.C. 154(b) by 40 days.

(21) Appl. No.: 10/872,474

(22) Filed: Jun. 22, 2004

(65) Prior Publication Data

US 2004/0267437 A1 Dec. 30, 2004

(30) Foreign Application Priority Data

Jun. 25, 2003 (JP) ..... 2003-181090

(51) Int. Cl.
*F02M 25/08* (2006.01)

(52) U.S. Cl. ..... 701/112

(58) Field of Classification Search ..... 701/112, 701/115

See application file for complete search history.

(56) References Cited

U.S. PATENT DOCUMENTS 5,263,462 A 11/1993 Reddy
6,434,453 B1 * 8/2002 Kuroda et al. ..... 701/112

FOREIGN PATENT DOCUMENTS

JP 1-257222 A * 10/1989
JP 2005-16382 A * 1/2005

* cited by examiner

*Primary Examiner*—Hieu T. Vo
(74) *Attorney, Agent, or Firm*—Foley & Lardner LLP

(57) ABSTRACT

When a vehicle state is detected during an engine is stopped, a sampling cycle of a detection signal indicating the vehicle state and a clock frequency of a CPU are changed, according to a change speed of the detection signal or an elapsed time after the engine is stopped.

20 Claims, 4 Drawing Sheets

CONTROL APPARATUS FOR VEHICLE AND METHOD THEREOF

FIELD OF THE INVENTION

The present invention relates to a control apparatus for a vehicle and a method thereof, and particularly, to a control apparatus for detecting a vehicle state in a condition where an engine is stopped and a method thereof.

RELATED ART

U.S. Pat. No. 5,263,462 discloses an apparatus for detecting a vehicle state after an engine is stopped.

The above apparatus is a diagnosis apparatus for diagnosing an occurrence of leakage in a fuel vapor purge system.

In the above diagnosis apparatus, a temperature and a pressure in a fuel tank are detected after the engine is stopped, and a change in the temperature and a change in the pressure are compared with each other, to diagnose an occurrence of leakage.

However, since a power generating mechanism does operate during the engine stop, if the diagnosis apparatus for the leakage diagnosis is operated for a long period of time, a battery being a power source of the diagnosis apparatus is burnt.

SUMMARY OF THE INVENTION

The present invention has an object to reduce the power consumption in a control apparatus for detecting a vehicle state after an engine is stopped.

In order to achieve the above object, the present invention has a configuration in which, when a detection signal is input while an engine is stopped, an operating frequency of a control unit is switched.

Further, the present invention has a configuration in which the detection signal is sampled to be stored while the engine is stopped, and the calculation on the stored detection signal is performed after the engine is restarted.

The other objects and features of this invention will become understood from the following description with reference to the accompanying drawings.

DESCRIPTION OF EMBODIMENTS

Figure 1:
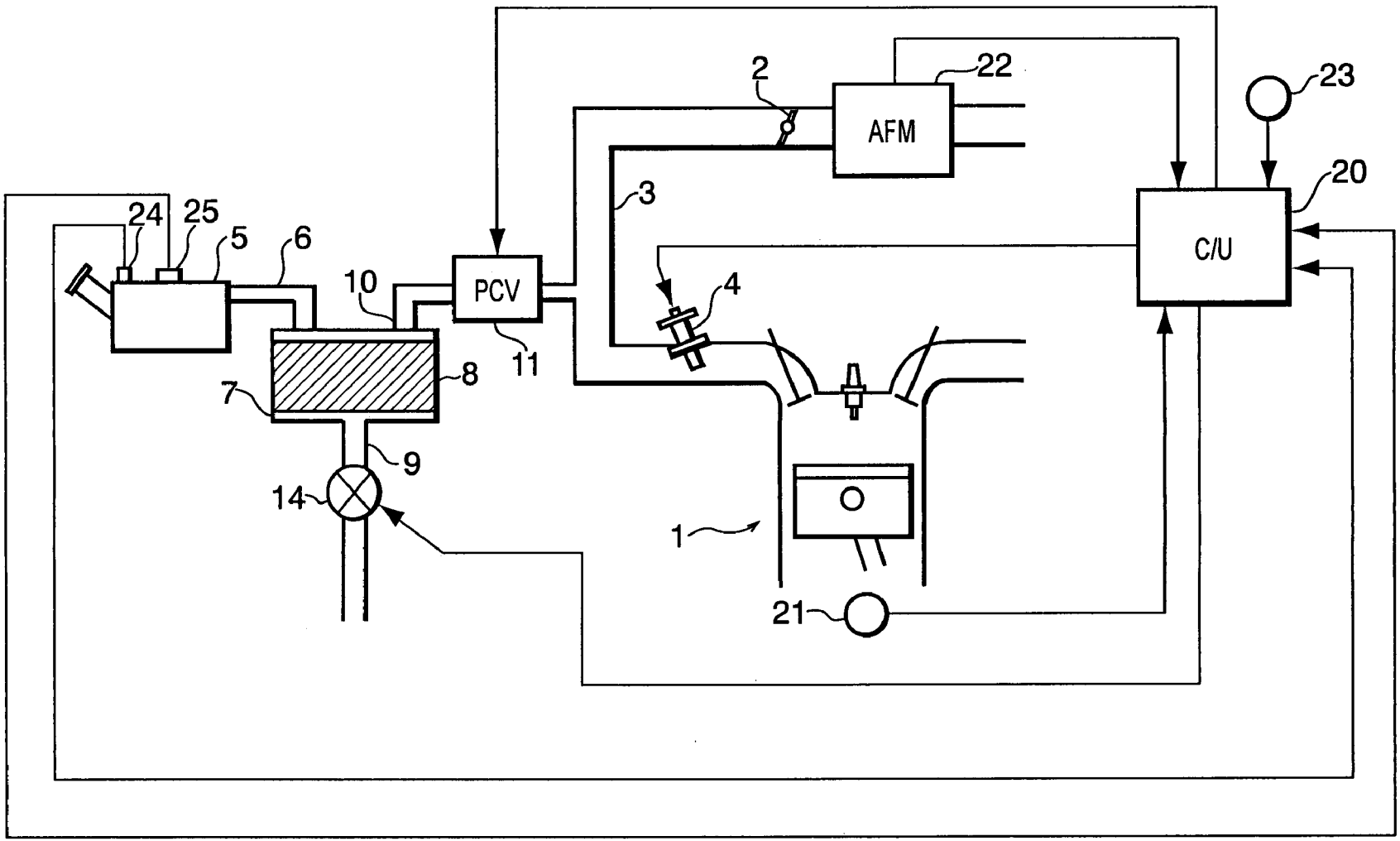
FIG. 1 is a diagram showing a system configuration of an engine in an embodiment.

FIG. 1 is a diagram showing a system configuration of an engine in an embodiment.

In FIG. 1, an engine 1 is an internal combustion engine using gasoline as fuel, which is installed in a vehicle (not shown in the figure).

A throttle valve 2 is disposed in an intake system of engine 1.

An intake air amount of engine 1 is controlled according to an opening of throttle valve 2.

For each cylinder, an electromagnetic type fuel injection valve 4 is disposed in a manifold portion of an intake passage 3 on the downstream side of throttle valve 2.

Fuel injection valve 4 is opened based on an injection pulse signal which is output from a control unit 20, to inject fuel.

Further, engine 1 is disposed with a fuel vapor purge system.

The fuel vapor purge system comprises an evaporation passage 6, a canister 7, a purge passage 10 and a purge control valve 11.

Fuel vapor generated in a fuel tank 5 is introduced into canister 7 via evaporation passage 6.

Canister 7 is a container filled with the adsorbent 8 such as activated carbon.

Further, a new air inlet 9 is formed to canister 7, and purge passage 10 is extended out from the canister.

Purge passage 10 is connected to intake passage 3 on the downstream side of throttle valve 2.

Closed type purge control valve 11 is disposed in the halfway of purge passage 10.

An opening of purge control valve 11 is controlled based on a purge control signal output from control unit 20.

The fuel vapor generated in fuel tank 5 is introduced by evaporation passage 6 into canister 7, to be adsorptively trapped in canister 7.

When a predetermined purge permission condition is established during an operation of engine 1, purge control valve 11 is controlled to open.

Then, as a result that an intake negative pressure of engine 1 acts on canister 7, the fuel vapor adsorbed in canister 7 is purged by the fresh air introduced through new air inlet 9.

Purged gas inclusive of the purged fuel vapor passes through purge passage 10 to be sucked in intake passage 3.

An electromagnetic valve 14 for blocking new air inlet 9 at the time of leakage diagnosis is disposed to new air inlet 9 of canister 7.

Electromagnetic valve 14 is a closed type electromagnetic valve, which is fully closed when there is no power supply.

Control unit 20 incorporates therein a microcomputer comprising a CPU, a ROM, a RAM, an A/D converter and an input/output interface.

Control unit receives detection signals from various sensors.

As the various sensors, there are provided a crank angle sensor 21 outputting a crank angle signal in synchronism with the rotation of engine 1, an air flow meter 22 detecting an intake air amount of engine 1, a vehicle speed sensor 23 detecting a vehicle speed, a pressure sensor 24 detecting a pressure in fuel tank 5, and a temperature sensor 25 detecting a temperature in fuel tank 5.

Note, there is provided a power generating mechanism which is driven by engine 1, and control unit 20 operates with a battery charged by the power generating mechanism as a power source thereof.

Control unit 20 controls fuel injection valve 4 and purge control valve 11 based on engine operating conditions detected by the various sensors.

Further, control unit 20 has a function of diagnosing an occurrence of leakage in the fuel vapor purge system.

The leakage diagnosis is performed, by detecting a pressure change in fuel tank 5 after engine 1 is stopped.

When engine 1 is stopped, and the power supply to purge control valve 11 and electromagnetic valve 14 is stopped, purge control valve 11 and electromagnetic valve 14 become in closed states.

In the closed states of purge control valve 11 and electromagnetic valve 14, a diagnosis zone containing fuel tank 5, evaporation passage 6, canister 7 and purge passage 10, is blocked.

Here, a pressure in the diagnosis zone is decreased due to condensation caused when a temperature of gasoline vapor is lowered.

Therefore, if the pressure in the diagnosis zone reaches a negative pressure due to depressurization, no leakage is judged. In the case where the pressure in the diagnosis zone does not reach the negative pressure, an occurrence of leakage is judged.

In the above leakage diagnosis, it is required that control unit 20 samples the detection signal from pressure sensor 24 after engine 1 is stopped.

However, the power generating mechanism does not operate during the engine stop, and accordingly, the battery being the power source of control unit 20 is not charged.

Therefore, if the power consumption of control unit 20 during the engine stop is large, the battery is burnt.

Here, the battery is also used as a power source of a starter for starting engine 1. Accordingly, the burning of battery deteriorates the startability of engine 1.

Figure 2:
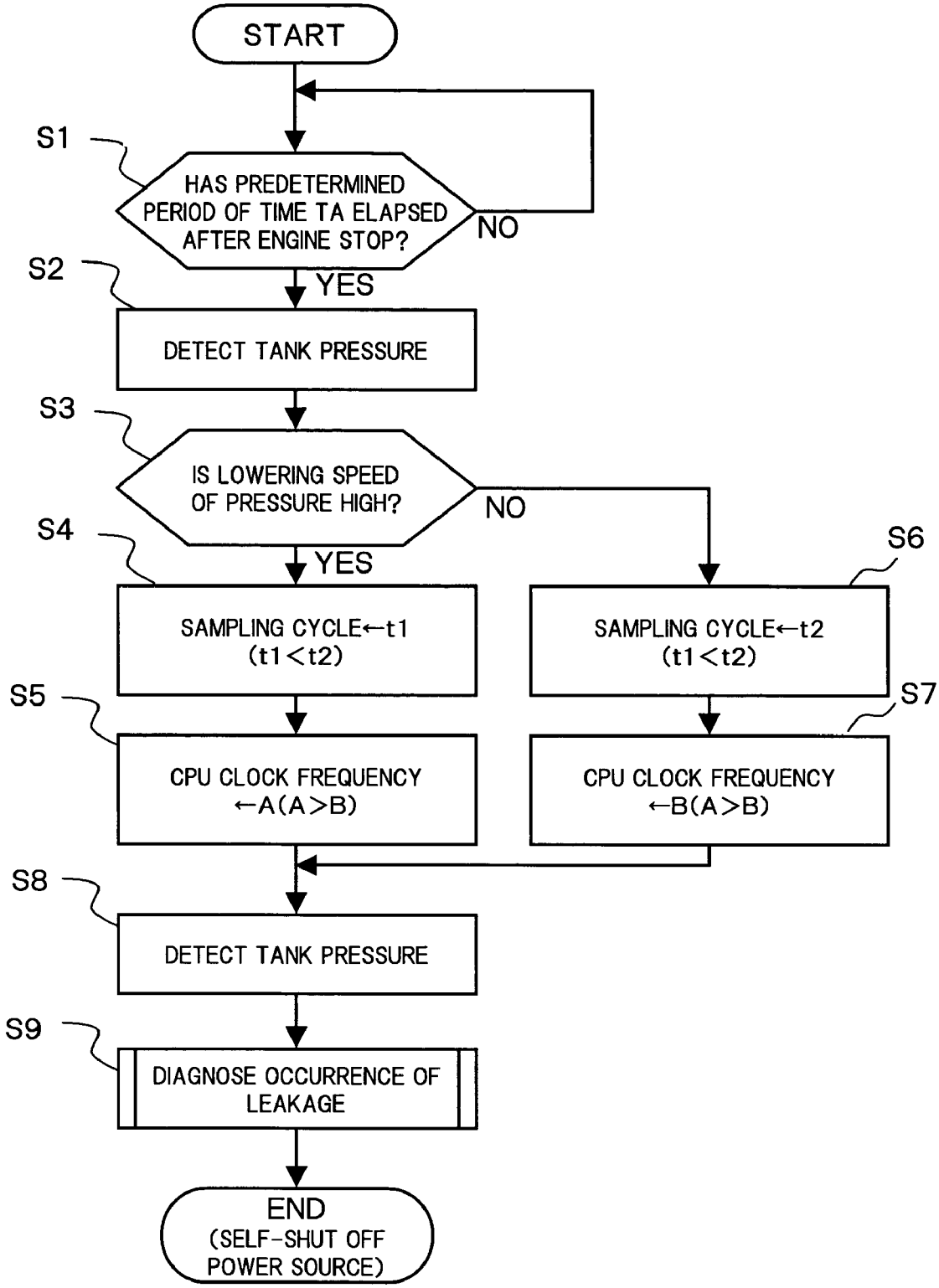
FIG. 2 is a flowchart showing a first embodiment of the present invention.

Thus, the power consumption of control unit 20 during the engine stop is reduced in accordance with the process shown in a flowchart of FIG. 2.

In the flowchart of FIG. 2, in step S1, it is judged whether or not a predetermined period of time TA has elapsed after the engine is stopped.

The predetermined period of time TA is a period of time during which the tank pressure rises just after the engine is stopped.

Then, if the predetermined period of time TA has elapsed, control proceeds to step S2.

In step S2, a tank pressure signal output from pressure sensor 24 is sampled at a predetermined cycle.

Namely, the detection signal from pressure sensor 24 is A/D converted by the A/D converter at the predetermined cycle.

The sampling cycle in step S2 is a short sampling cycle t0, which is given as an initial value, and a clock frequency of the CPU at that time is set to a high frequency C corresponding to the sampling cycle t0.

Note, the configuration may be such that the tank pressure signal is sampled just after the engine is stopped, and control proceeds to step S3 after a result of the sampling indicates a decrease tendency of the tank pressure.

In step S3, it is judged whether or not a lowering speed of the tank pressure calculated based on a sampling result in step S2, is equal to or higher than a predetermined speed.

If the lowering speed of the tank pressure is equal to or higher than the predetermined speed, control proceeds to step S4.

In step S4, the sampling cycle of the tank pressure is set to a predetermined set time t1.

Note, time t1>time t0.

The sampling cycle is a conversion cycle by the A/D converter, and is equivalent to an operation frequency in the present invention.

In next step S5, a frequency A previously set as a minimum frequency enabling the sampling process at time t1, is set to the clock frequency of the CPU.

Note, frequency A<frequency C.

On the other hand, if the lowering speed of the tank pressure is less than the predetermined speed, control proceeds to step S6.

In step S6, the sampling cycle of the tank pressure is set to a previously set time t2.

Here, time t2>time t1>time t0.

In next step S7, a frequency B previously set as a minimum frequency enabling the sampling process at time t2, is set to the clock frequency of the CPU.

Note, frequency B<frequency A<frequency C.

Then, in step S8, the detection signal from pressure sensor 24, which is sampled at each sampling cycle, is calculated by the CPU operating at the clock frequency, and the pressure in fuel tank 5 is detected.

In step S9, it is judged whether or not the most newly detected pressure in fuel tank 5 reaches a negative pressure.

Then, if the pressure in fuel tank 5 reaches the negative pressure, no leakage is judged.

On the other hand, in the case the pressure in fuel tank 5 does not reach the negative pressure although the sampling of pressure in fuel tank 5 is repetitively performed for a predetermined period of time TB, an occurrence of leakage is judged.

After the leakage diagnosis is finished, control unit 20 shuts off the power source by itself.

The power consumption exhibits a tendency to be increased, if the operation frequency of the A/D converter or the CPU is increased.

Therefore, if the operation frequencies of the A/D converter and the CPU after the engine is stopped, are lowered, the power consumption in control unit 20 during the engine stop can be reduced, thereby enabling the suppression of battery burning.

Accordingly, it is possible to avoid the degradation of engine startability due to the battery burning during the engine stop.

Further, if the pressure is detected at a short cycle when a change speed of the pressure in fuel tank 5 is high, it is possible to detect with good responsibility that the pressure in fuel tank is lowered to the negative pressure, and as a result, the diagnosis can be finished in a short time.

In the case where, since the change speed of the pressure in fuel tank is low, and accordingly, a time is required until it is confirmed as to whether or not the pressure is lowered to the negative pressure, the sampling cycle is made to be longer and the clock frequency of the CPU is further lowered. Therefore, the power consumption can be reduced even if the diagnosis time becomes longer.

Note, the configuration may be such that only either the sampling cycle or the clock frequency of the CPU is switched.

Further, in the sampling of the detection signal and the leakage diagnosis after the engine is stopped, a high operation frequency is not required, compared to the engine control time.

Therefore, the frequency of the A/D converter and the clock frequency of the CPU can be fixed to minimum values necessary for the sampling process of pressure during the engine stop.

Moreover, since the temperature in fuel tank 5 during the engine stop affects the pressure change in fuel tank 5 thereafter, the sampling cycle and/or the clock frequency of the CPU can be switched based on the temperature in fuel tank 5.

Furthermore, the temperature in fuel tank 5 is changed depending on the engine operating time, and the temperature in fuel tank 5 correlates with a cooling water temperature of the engine.

Therefore, it is possible to switch the sampling cycle and/or the clock frequency of the CPU, based on the engine operating time and/or the cooling water temperature at the time when the engine is stopped.

Further, in the case where the sampling cycle is made to be longer, it is possible that the CPU is temporarily made to be in a halt condition between each of sampling time, and the CPU is returned to the operating condition when reaching the sampling time.

Moreover, since the change speed of the pressure in fuel tank 5 is reduced with the lapse of time, it is possible to change the sampling cycle and/or the clock frequency of the CPU, according to the elapsed time.

Figure 3:
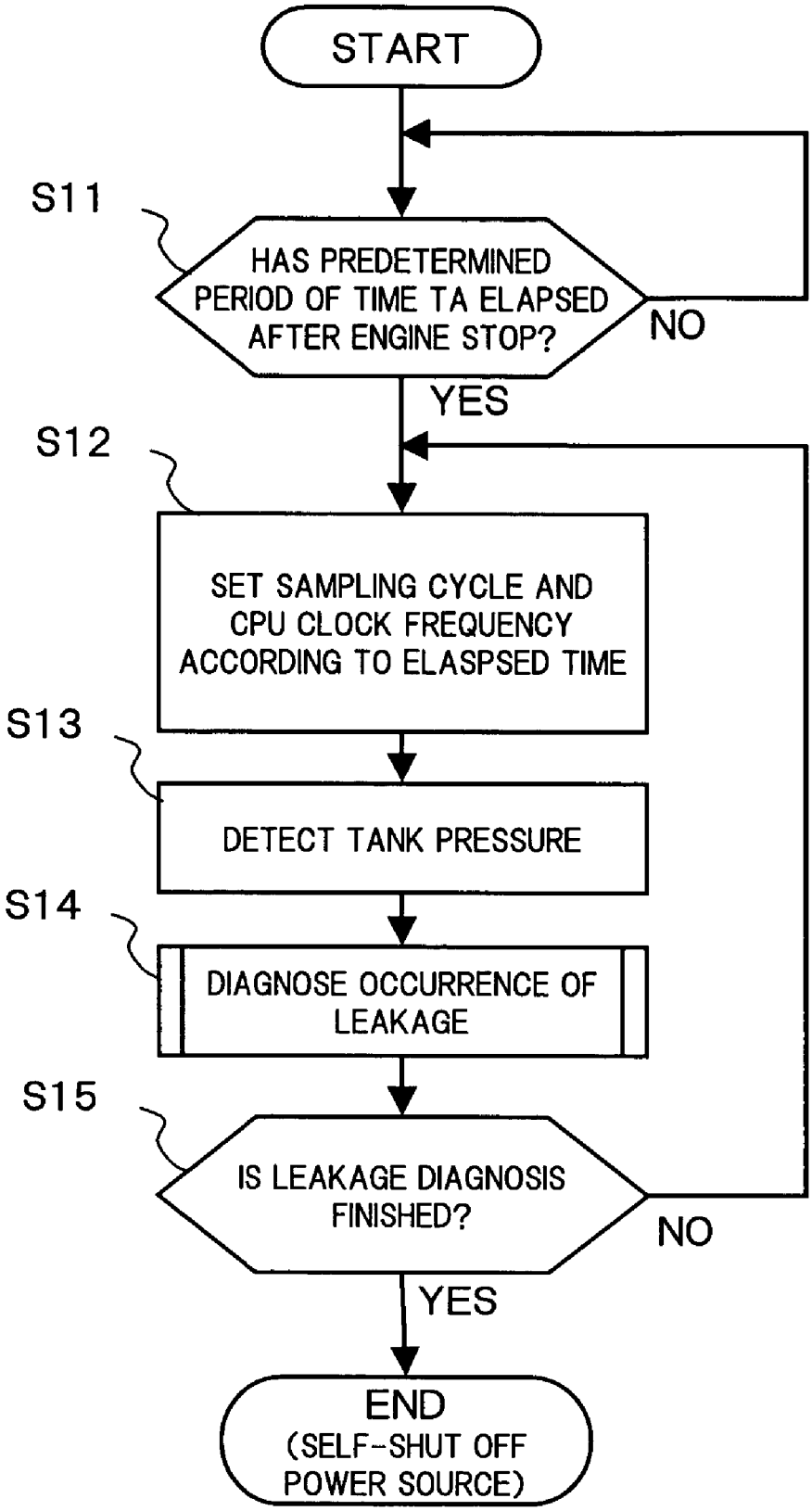
FIG. 3 is a flowchart showing a second embodiment of the present invention.

A flowchart of FIG. 3 shows an embodiment in which the sampling cycle and the clock frequency of the CPU are changed, according to an elapsed time after the engine is stopped.

In the flowchart of FIG. 3, it is detected in step S11 that the predetermined period of time TA has elapsed after the engine is stopped, control proceeds to step S12.

In step S12, referring to a table previously storing the sampling cycle and the clock frequency of the CPU according to the elapsed time after the engine is stopped, the sampling cycle and the clock frequency of the CPU are set.

In step S13, in accordance with the sampling cycle, the detection signal from pressure sensor 24 is sampled, to detect the pressure in fuel tank 5.

In step S14, the leakage diagnosis is performed based on the pressure in fuel tank 5 detected in step S13.

Namely, if the pressure in fuel tank 5 reaches the negative pressure, no leakage is judged. If the pressure in fuel tank 5 does not reach the negative pressure although the sampling of tank pressure is repetitively performed for the predetermined period of time TB, an occurrence of leakage is judged.

In step S15, it is judged whether or not the leakage diagnosis has been finished.

Then, if the leakage diagnosis has not been finished, control returns step S12.

In the above configuration, it is possible that the pressure in fuel tank 5, the change speed of which is lowered with the lapse of time, is sampled at a required and sufficient cycle, and also the CPU is made to operate at the clock frequency corresponding to this sampling cycle.

Further, if the configuration is such that the sampling cycle and the clock frequency of the CPU are changed with the lapse of time, the calculation of the change speed of the pressure in fuel tank 5 is no longer necessary.

Incidentally, it is possible that only the process of sampling the pressure in fuel tank 5 to store the sampled pressure is performed during the engine stop, and the leakage diagnosis based on the sampled pressure is performed after the engine is restarted.

Figure 4:
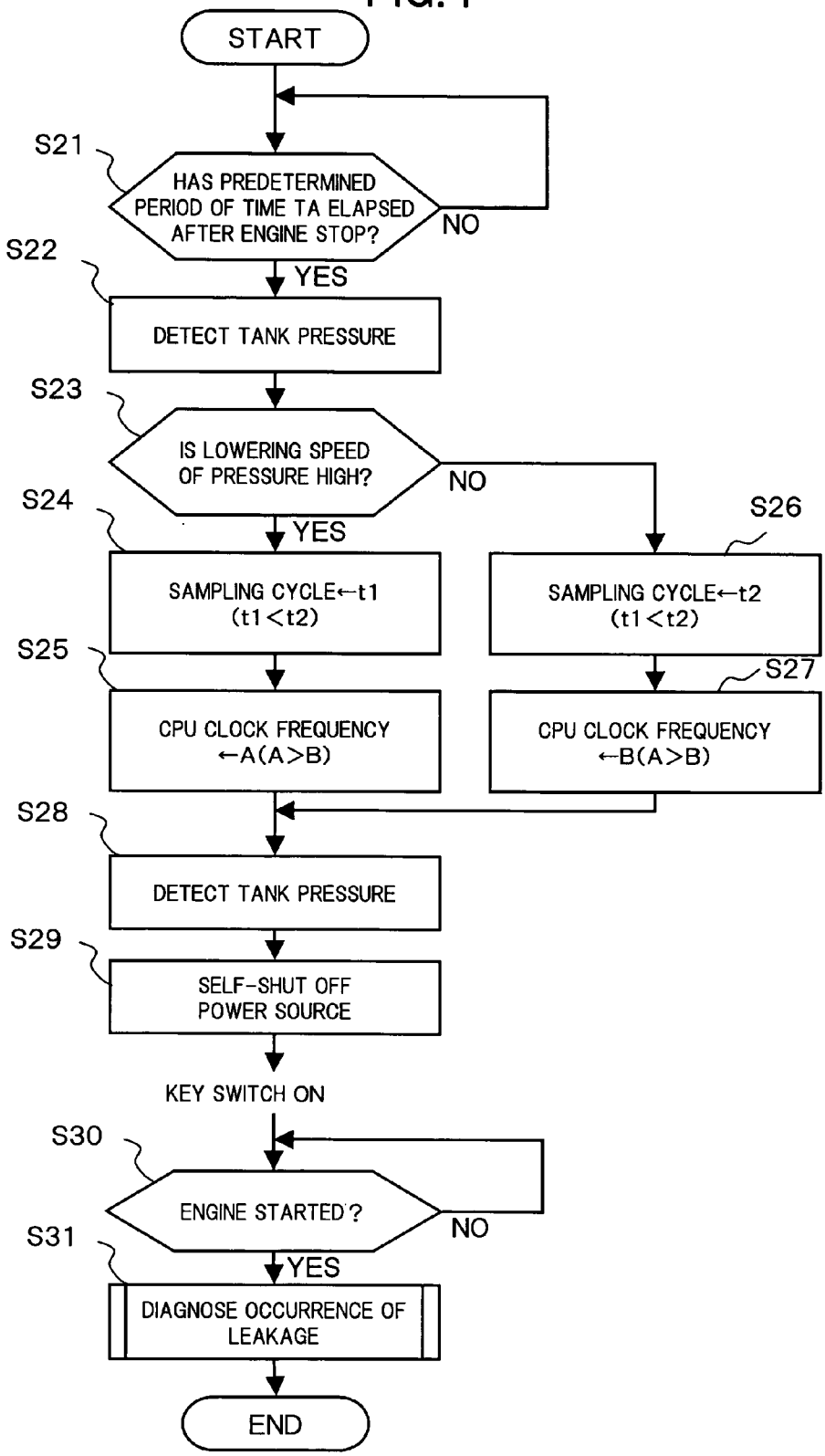
FIG. 4 is a flowchart showing a third embodiment of the present invention.

A flowchart of FIG. 4 shows an embodiment of the above configuration.

In the flowchart of FIG. 4, the process in steps S21 to S28 is executed in the same manner as steps S1 to S8 in the flowchart of FIG. 2.

Namely, the pressure in fuel tank 5 is detected based on the sampling cycle and the clock frequency of the CPU according to the lowering speed of the pressure, and the detection result is stored.

In step S29, control unit shuts off the power source by itself.

Then, when the power is again supplied to control unit 20 with an ON operation of a key switch, it is judged in step S30 whether or not the engine is restarted.

Then, if the engine is restarted, control proceeds to step S31, where the leakage diagnosis is performed based on data of pressure in fuel tank 5 stored during the engine stop.

According to the above configuration, only the sampling and the storing process, which require the relatively low power consumption, are performed during the engine stop, while an occurrence of leakage being judged after the engine is started at which the power generating mechanism operates. As a result, the power consumption of control unit during the engine stop can be reduced.

Note, in the configuration in which the leakage diagnosis is performed after the engine is started based on the stored data of pressure, it is possible to change the sampling cycle and the clock frequency of the CPU, according to the elapsed time after the engine is stopped.

Further, the sampling of detection signal after the engine is stopped, is not limited to be used for leakage diagnosis, and the sensor detecting the vehicle state is not limited to tank pressure sensor 24.

The entire contents of Japanese Patent Application No. 2003-181090 filed on Jun. 25, 2003, a priority of which is claimed, are incorporated herein by reference.

While only selected embodiments have been chosen to illustrate the present invention, it will be apparent to those skilled in the art from this disclosure that various changes and modifications can be made herein without departing from the scope of the invention as defined in the appended claims.

Furthermore, the foregoing description of the embodiments according to the present invention is provided for illustration only, and not for the purpose of limiting the invention as defined in the appended claims and their equivalents.

What is claimed is:

1. A control apparatus for a vehicle in which an engine is installed, comprising:

a detector detecting a state of said vehicle to output a detection signal;

a control unit that receives the detection signal from said detector, wherein said control unit switches an operation frequency when receiving said detection signal while said engine is stopped.

2. A control apparatus for a vehicle according to claim 1, wherein said control unit switches said operation frequency according to an elapsed time after said engine is stopped.

3. A control apparatus for a vehicle according to claim 1, wherein said control unit switches said operation frequency according to a change speed of said detection signal.

4. A control apparatus for a vehicle according to claim 1, wherein the operation frequency in said control unit is a sampling cycle of said detection signal.

5. A control apparatus for a vehicle according to claim 1, wherein said control unit comprises a microcomputer, and the operation frequency in said control unit is a clock frequency of a CPU included in said microcomputer.

6. A control apparatus for a vehicle according to claim 1, wherein said control unit is temporarily halted between each sampling time of said detection signal while said engine is stopped.

7. A control apparatus for a vehicle according to claim 1, wherein the operation frequency in said control unit while said engine is stopped is lower than the operation frequency in said control unit at the time when said engine is operating.

8. A control apparatus for a vehicle according to claim 1, wherein said control unit samples said detection signal while said engine is stopped, stores the sampled detection signal, and performs a calculation on said stored detection signal after said engine is restarted.

9. A control apparatus for a vehicle in which an engine is installed, comprising:

a detector detecting a state of said vehicle;

a control unit that receives the detection signal from said detector, wherein said control unit samples said detection signal while said engine is stopped, stores the sampled detection signal, and performs a calculation on said stored detection signal after said engine is restarted.

10. A control apparatus for a vehicle in which an engine is installed, comprising:

detecting means for detecting a state of said vehicle to output a detection signal;

calculating means for receiving said detection signal and performing a calculation on said detection signal; and means for switching an operation frequency of said calculating means when said calculating means receives said detection signal while said engine is stopped.

11. A control apparatus for a vehicle in which an engine is installed, comprising:

detecting means for detecting a state of said vehicle to output a detection signal; and calculating means for sampling said detection signal while said engine is stopped, storing the sampled detection signal, and performing the calculation on said stored detection signal after said engine is restarted.

12. A control method for a vehicle in which an engine is installed, comprising the steps of:

judging that said engine is stopped;

receiving a detection signal indicating a state of said vehicle while said engine is stopped; and switching an operation frequency for the receiving of said detection signal while said engine is stopped.

13. A control method for a vehicle according to claim 12, wherein said step of switching the operation frequency comprises the steps of:

measuring an elapsed time after said engine is stopped; and switching said operation frequency according to the elapsed time.

14. A control method for a vehicle according to claim 13, wherein said step of switching the operation frequency comprises the steps of:

detecting a change speed of said detection signal; and switching said operation frequency according to said change speed.

15. A control method for a vehicle according to claim 12, wherein said step of switching the operation frequency switches a sampling cycle of said detection signal.

16. A control method for a vehicle according to claim 12, wherein said receiving of said detection signal is performed by a microcomputer, and said step of switching the operation frequency comprises the step of switching a clock frequency of a CPU included in said microcomputer.

17. A control method for a vehicle according to claim 12, wherein said receiving process of said detection signal is performed by a microcomputer, and said microcomputer is temporarily halted between each sampling time of said detection signal while said engine is stopped.

18. A control method for a vehicle according to claim 12, wherein said step of switching the operation frequency comprises the step of lowering the operation frequency while said engine is stopped compared with the operation frequency at the time when said engine is operating.

19. A control method for a vehicle according to claim 12, further comprising the steps of:

storing the input detection signal while said engine is stopped; and performing a calculation on said stored detection signal after said engine is restarted.

20. A control method for a vehicle on which an engine is installed, comprising the steps of:

judging that said engine is stopped;

receiving a detection signal indicating a state of said vehicle while said engine is stopped;

switching an operation frequency for the receiving of said detection signal while said engine is stopped;

storing said received detection signal; and performing a calculation on said stored detection signal after said engine is restarted.

* * * * *